US009774151B2

(12) United States Patent
Kobayashi et al.

(10) Patent No.: US 9,774,151 B2
(45) Date of Patent: Sep. 26, 2017

(54) CABLE CONNECTION STRUCTURE

(71) Applicant: OLYMPUS CORPORATION, Tokyo (JP)

(72) Inventors: Keiichi Kobayashi, Nagano (JP); Junya Yamada, Kawasaki (JP)

(73) Assignee: OLYMPUS CORPORATION, Tokyo (JP)

( * ) Notice: Subject to any disclaimer, the term of this patent is extended or adjusted under 35 U.S.C. 154(b) by 0 days.

(21) Appl. No.: 14/963,403

(22) Filed: Dec. 9, 2015

(65) Prior Publication Data

US 2016/0093991 A1 Mar. 31, 2016

Related U.S. Application Data

(63) Continuation of application No. PCT/JP2014/064964, filed on Jun. 5, 2014.

(30) Foreign Application Priority Data

Jun. 10, 2013 (JP) ..... 2013-122004

(51) Int. Cl.
*H01R 4/00* (2006.01)
*H01R 24/50* (2011.01)
(Continued)

(52) U.S. Cl.
CPC ..... *H01R 24/50* (2013.01); *H01R 12/53* (2013.01); *H01R 24/38* (2013.01); *H01R 9/0515* (2013.01); *H01R 12/57* (2013.01); *H01R 2107/00* (2013.01)

(58) Field of Classification Search
CPC ..... H01R 4/70; H01R 4/723; H01R 2103/00; H01R 24/50; H02G 15/18; H02G 15/10
(Continued)

(56) References Cited

U.S. PATENT DOCUMENTS 6,842,093 B2 * 1/2005 Tamaki ..... H01P 5/085 333/260
6,857,898 B2 * 2/2005 Engquist ..... H01R 9/0515 439/493
(Continued)

FOREIGN PATENT DOCUMENTS

CN 102099873 A1 6/2011
JP S63-231887 A 9/1988
(Continued)

OTHER PUBLICATIONS

International Search Report dated Aug. 26, 2014 issued in PCT/JP2014/064964.
(Continued)

*Primary Examiner* — Hien Vu
(74) *Attorney, Agent, or Firm* — Scully, Scott, Murphy & Presser, P.C.

(57) ABSTRACT

A cable connection structure includes cables and a substrate having an electrode thereon. The cables are configured to be connected to the electrode. Each cable includes: a core wire formed of conductive material; a tubular inner insulator for covering an outer circumference of the core wire; a shield which extends along a longitudinal direction of the inner insulator and includes conductors for covering an outer circumference of the inner insulator, and has an exposed portion for exposing the inner insulator; and an outer insulator for covering an outer circumference of the shield. The shield including a region where the exposed portion is formed, the inner insulator, and the core wire are exposed in a stepped manner toward a distal end of each cable. The substrate includes a first electrode configured to be electrically connected to the core wire, and a second electrode configured to be electrically connected to the shield.

3 Claims, 8 Drawing Sheets

(51) Int. Cl.

| | |
|---|---|
| ***H01R 12/53*** | (2011.01) |
| ***H01R 24/38*** | (2011.01) |
| *H01R 107/00* | (2006.01) |
| *H01R 9/05* | (2006.01) |
| *H01R 12/57* | (2011.01) |

(58) Field of Classification Search
USPC ..... 439/63, 579, 581, 497; 174/84 R, 88 R
See application file for complete search history.

(56) References Cited

U.S. PATENT DOCUMENTS

| | | | | |
|---|---|---|---|---|
| 8,043,114 | B2 * | 10/2011 | Kaneko | H01R 13/65802 439/468 |
| 2003/0221866 | A1 | 12/2003 | Tang | |
| 2007/0181337 | A1 * | 8/2007 | Miller | H01R 9/0515 174/261 |
| 2013/0005181 | A1 | 1/2013 | Yamada et al. | |

FOREIGN PATENT DOCUMENTS

| | | | |
|---|---|---|---|
| JP | H06-029067 | A | 2/1994 |
| JP | 2001-068175 | A | 3/2001 |
| JP | 2003-168499 | A | 6/2003 |
| JP | 2007-194186 | A | 8/2007 |
| JP | 2008-034207 | A | 2/2008 |
| JP | 2011-222277 | A | 11/2011 |

OTHER PUBLICATIONS

Chinese Office Action dated Mar. 24, 2017 in Chinese Patent Application No. 201480032879.6.

* cited by examiner

CABLE CONNECTION STRUCTURE

CROSS-REFERENCE TO RELATED APPLICATIONS

This application is a continuation of PCT international application Ser. No. PCT/JP2014/064964 filed on Jun. 5, 2014 which designates the United States, incorporated herein by reference, and which claims the benefit of priority from Japanese Patent Application No. 2013-122004, filed on Jun. 10, 2013, incorporated herein by reference.

BACKGROUND

1. Technical Field

The disclosure relates to a cable connection structure for connecting a cable to a substrate.

2. Related Art

A cable connection structure for connecting a substrate having an electronic component mounted thereon to a cable has been used in the related art according to a kind of a device such as a digital camera, a digital video camera, a portable telephone including an imaging function, and an endoscope device to observe inside of an organ of a subject.

The endoscope device of the above devices has flexibility and includes a long and thin insertion tool which is inserted in a body of the subject and obtains an image signal regarding the inside of the organ and a signal processing unit which is connected to the insertion tool and performs signal processing to the image signal. In a distal end part of the insertion tool, an imaging unit which includes a substrate including an imaging element having a plurality of pixels mounted thereon is connected to a cable of which one end is connected to the signal processing unit. The image signal imaged by the imaging unit is transmitted to the signal processing unit via the cable.

Regarding the endoscope device, the distal end part of the insertion tool has been required to be smaller in order to reduce a burden on the subject. According to this demand, the cable connection structure in the distal end part has been required to be small.

In response to the above-mentioned demand, a technique has been known in which the attachment height of the cable relative to the substrate is lowered by forming a slit on an upper surface (surface to be connected) of the substrate and connecting the substrate to the cable by putting a part of the cable into the slit in a connection structure of a coaxial cable for connecting the cable to the substrate (See Japanese Patent Application Laid-open No. 2001-68175, for example).

SUMMARY

In some embodiments, a cable connection structure includes: one or a plurality of cables; and a substrate having an electrode thereon, the one or the plurality of cables being configured to be connected to the electrode. Each of the one or the plurality of cables includes: a core wire formed of a line-shaped conductive material; a tubular inner insulator which is formed of an insulator and covers an outer circumference of the core wire; a shield which extends along a longitudinal direction of the inner insulator and includes a plurality of conductors for covering an outer circumference of the inner insulator, and has an exposed portion for exposing the inner insulator; and an outer insulator formed of an insulator for covering an outer circumference of the shield. The shield including a region where the exposed portion is formed, the inner insulator, and the core wire are exposed in a stepped manner toward a distal end of each cable. The substrate includes: a first electrode configured to be electrically connected to the core wire; and a second electrode configured to be electrically connected to the shield. The inner insulator has contact with the second electrode in a portion where the inner insulator is exposed through the exposed portion.

The above and other features, advantages and technical and industrial significance of this invention will be better understood by reading the following detailed description of presently preferred embodiments of the invention, when considered in connection with the accompanying drawings.

DETAILED DESCRIPTION

Embodiments of a cable connection structure according to the present invention will be described below with reference to the drawings. The present invention is not limited to the embodiments. The same reference signs are used to designate the same elements throughout the drawings.

First Embodiment

Figure 1:
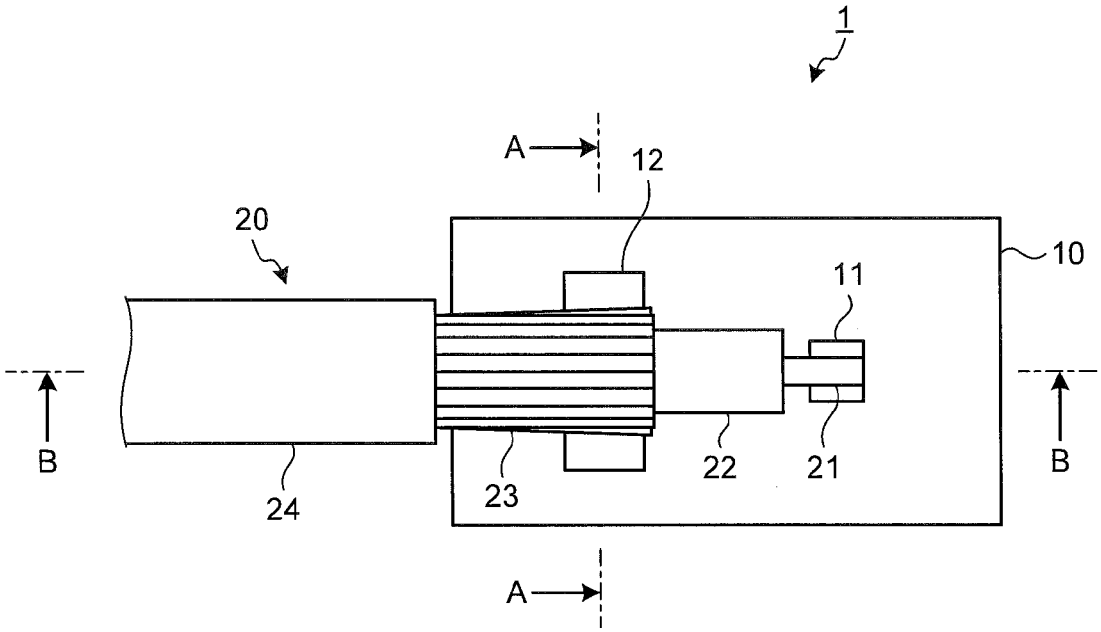
FIG. 1 is a schematic diagram of an outline structure of a cable connection structure according to a first embodiment of the present invention.
Figure 2:
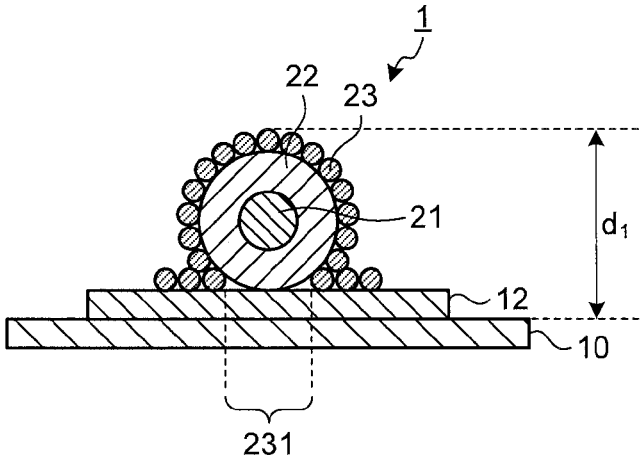
FIG. 2 is an A-A line sectional view of the cable connection structure illustrated in FIG. 1.
Figure 3:
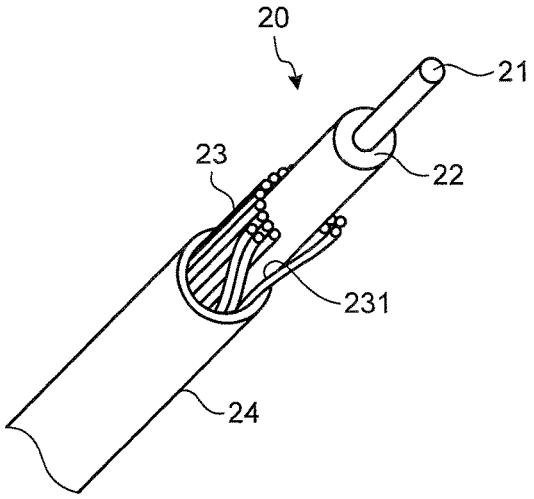
FIG. 3 is a schematic perspective view of a cable of the cable connection structure according to the first embodiment of the present invention.
Figure 4:
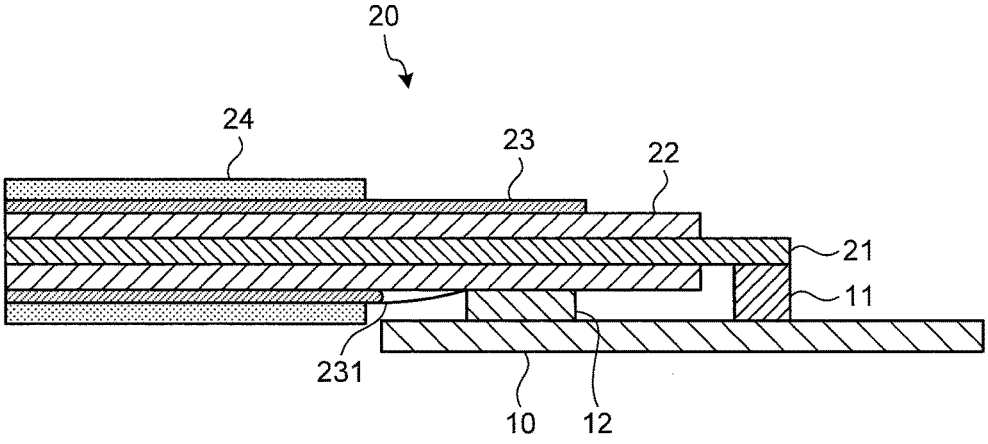
FIG. 4 is a B-B line sectional view of the cable connection structure illustrated in FIG. 1.

FIG. 1 is a schematic diagram of an outline structure of a cable connection structure according to a first embodiment of the present invention. FIG. 2 is an A-A line sectional view of the cable connection structure illustrated in FIG. 1. FIG. 3 is a schematic perspective view of a cable of the cable connection structure according to the first embodiment. FIG. 4 is a B-B line sectional view of the cable connection structure illustrated in FIG. 1. A cable connection structure 1 according to the first embodiment includes a substrate 10 having electronic components mounted thereon and a cable 20 connected to the substrate 10. The cable 20 will be described below while the cable 20 is assumed as a coaxial cable.

The substrate 10 has a substantially plate shape, and an electric circuit, an electrode, and the like are formed on at least one principal surface. Also, on one principal surface of the substrate 10, a first electrode 11 and a second electrode 12 electrically connected to the cable 20 are formed. Here, the first electrode 11 is a connection electrode connected to the cable 20. The second electrode 12 is a ground electrode having a substantially plate shape.

The cable 20 includes: a core wire 21 formed of a line-shaped conductor (conductive material) made of copper and the like; a tubular inner insulator 22 which is formed of an insulator, covers the outer circumference of the core wire 21, and exposes the core wire 21 on a distal end side of the inner insulator 22; a shield 23 which extends along the longitudinal direction of the inner insulator 22 and includes a plurality of conductors for covering the outer circumference of the inner insulator 22; and an outer insulator 24 which is formed of an insulator for covering the outer circumference of the shield 23. The inner insulator 22, the shield 23, and the outer insulator 24 are stripped in a stepped manner to form the cable 20 at the end part where the substrate 10 is connected. In the cable 20, by this stripping, the shield 23, the inner insulator 22, and the core wire 21 are exposed in a stepped manner toward the distal end. The conductor of the shield 23 is made of the line-shaped conductive material.

Here, in a region of the shield 23 exposed by the stripping, an exposed portion 231 is formed (refer to FIG. 3). The exposed portion 231 is formed by separating a part of the conductors to expose a part of the inner insulator 22. The conductors of the shield 23 are arranged while aligning the longitudinal directions with each other and arranged along the outer circumference of the inner insulator 22. A cross section of the shield 23 having a plane perpendicular to the longitudinal direction as a cut surface has a substantially annular shape.

In the substrate 10 and the cable 20, the first electrode 11 and the core wire 21 are fixed with a joining member and electrically connected to each other. As the joining member, a conductive joining member, which is not illustrated, such as solder, an anisotropic conductive film (ACF), and anisotropic conductive paste (ACP) is exemplified.

The cable 20 is arranged such that the exposed portion 231 of the shield 23 faces to the second electrode 12. The cable 20 is connected to the substrate 10 in a state where the surface of the inner insulator 22 in the exposed portion 231 has contact with the second electrode 12. The conductors separated to form the exposed portion 231 of the shield 23 are fixed on the second electrode 12 via the above-mentioned joining material.

Here, in the cross section illustrated in FIG. 2, a distance $d_1$ between the principal surface of the substrate 10 and the end on the opposite side to the principal surface of the substrate 10 in the shield 23 is smaller than a value obtained by adding a diameter of a circle having contact with the outer edge of each conductor of the shield 23 to a board thickness of the second electrode 12 (distance perpendicular to the principal surface). The distance $d_1$ corresponds to the length in the direction perpendicular to the principal surface of the substrate 10 and in the direction for passing through the center of the cable 20 (core wire 21).

In this way, the substrate 10 is connected to the second electrode 12 in a state where the exposed portion 231 has been formed and the inner insulator 22 has had contact with the second electrode 12. Accordingly, the attachment height of the cable 20 relative to the substrate 10 can be lower than that in a case where the exposed portion 231 is not formed in the shield 23. Also, the attachment height of the cable 20 relative to the substrate 10 can be further lowered by reducing the thicknesses of the first electrode 11 and the second electrode 12.

According to the first embodiment, in the shield 23, the exposed portion 231, in which a part of the inner insulator 22 is exposed, is formed by separating a part of the conductor, and the inner insulator 22 has contact with the second electrode 12 through the exposed portion 231. Also, the cable 20 is connected to the substrate 10 by contacting the conductor separated to form the exposed portion 231 with the second electrode 12. Therefore, the attachment height of the cable relative to the substrate can be lowered without microfabrication on the substrate.

Further, according to the first embodiment, a connecting position of the core wire 21 to the first electrode 11 can be lowered by lowering the attachment height of the cable by contacting the inner insulator 22 with the second electrode 12 through the exposed portion 231. Accordingly, a connection state of the core wire 21 to the first electrode 11 can be stabilized, and the reliability regarding the connection between the substrate 10 and the cable 20 can be improved.

Further, according to the first embodiment, by contacting the conductors separated to form the exposed portion 231 with the second electrode 12, a shield function by the shield 23 can be secured, and the joining strength between the substrate 10 and the cable 20 can be improved.

Further, according to the first embodiment, in the substrate 10, it is not necessary to form a slit where the cable 20 is put in, and manufacturing cost to form the slit can be made unnecessary.

Second Embodiment

Figure 5:
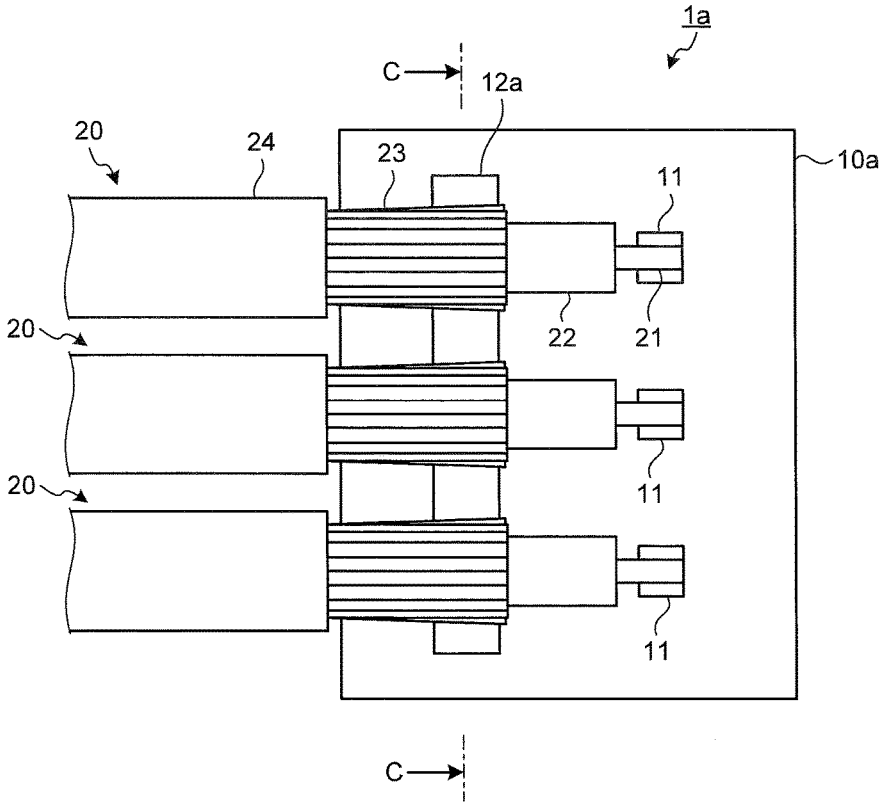
FIG. 5 is a schematic diagram of an outline structure of a cable connection structure according to a second embodiment of the present invention.
Figure 6:
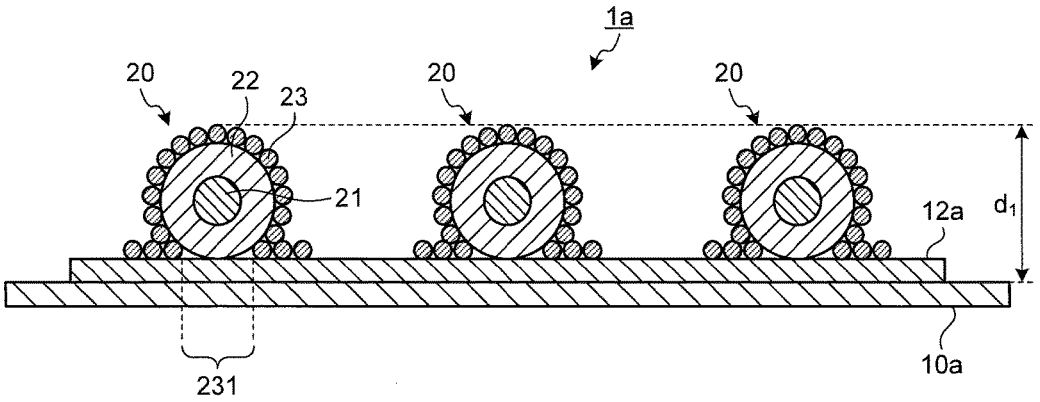
FIG. 6 is a C-C line sectional view of the cable connection structure illustrated in FIG. 5.

FIG. 5 is a schematic diagram of an outline structure of a cable connection structure according to a second embodiment of the present invention. FIG. 6 is a C-C line sectional view of the cable connection structure illustrated in FIG. 5. The same reference signs are used to designate the same elements as the above-described elements. In a cable connection structure 1*a* according to the second embodiment, a plurality of cables 20 is connected to a substrate 10*a*.

The substrate 10*a* has a substantially plate shape, and an electric circuit, an electrode, and the like are formed on at least one principal surface. A plurality of first electrodes 11 electrically connected to the cables 20 is formed on one principal surface of the substrate 10*a*. On one principal surface of the substrate 10*a*, a second electrode 12*a* is formed which extends in an arrangement direction of the plurality of cables 20 and is connected to the shields 23 of the cables 20. The second electrode 12*a* is a shield connection electrode having a substantially plate shape and connected to each shield 23.

As described above, the cable 20 is arranged such that the exposed portions 231 of the shields 23 face to the second electrode 12*a*. The cable 20 is connected to the substrate 10*a* in a state where the surfaces of the inner insulators 22 in the exposed portions 231 have contact with the second electrode 12*a*. The conductors separated to form the exposed portion 231 of the shield 23 are fixed on the second electrode 12*a* via the joining material.

Here, similarly to the first embodiment, a distance between the principal surface of the substrate 10*a* and the end of the shield 23 becomes the distance $d_1$ (refer to FIG. 2) smaller than a value obtained by adding a diameter of a circle having contact with the outer edge of each conductor of the shield 23 to a board thickness of the second electrode 12*a*.

In this way, the substrate 10*a* is connected to the second electrode 12*a* in a state where the exposed portion 231 has been formed and the inner insulator 22 has had contact with the second electrode 12*a*. Accordingly, the attachment height of the cable 20 relative to the substrate 10*a* can be lower than that in a case where the exposed portion 231 is not formed in the shield 23.

According to the second embodiment, in the shield 23, the exposed portion 231, in which a part of the inner insulator 22 is exposed, is formed by separating a part of the conductors, and the inner insulator 22 has contact with the second electrode 12*a* through the exposed portion 231. Also, the plurality of cables 20 is connected to the substrate 10*a* by contacting the conductor separated to form the exposed portion 231 with the second electrode 12*a*. Therefore, the attachment height of the cable relative to the substrate can be lowered without microfabrication on the substrate.

Third Embodiment

Figure 7:
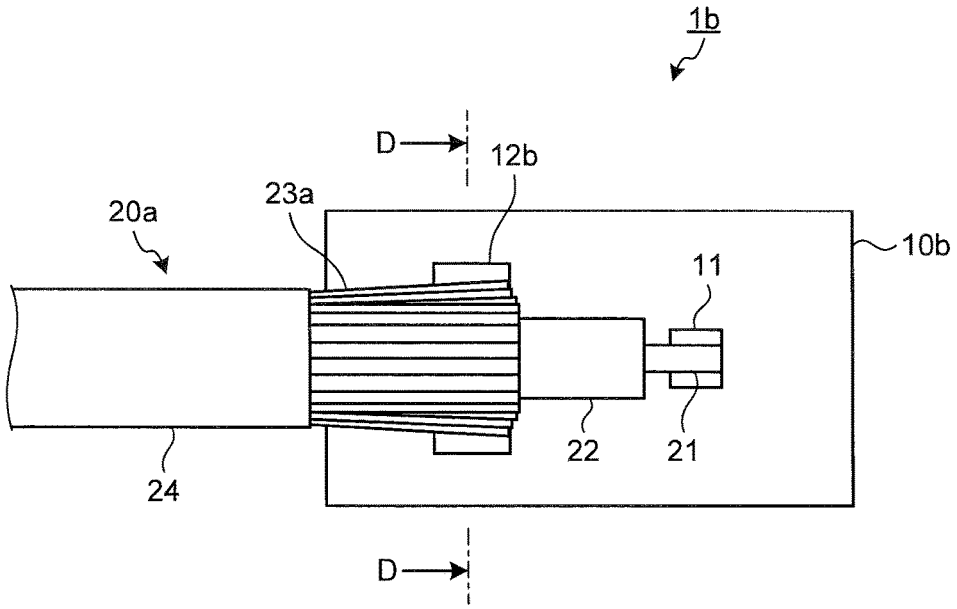
FIG. 7 is a schematic diagram of an outline structure of a cable connection structure according to a third embodiment of the present invention.
Figure 8:
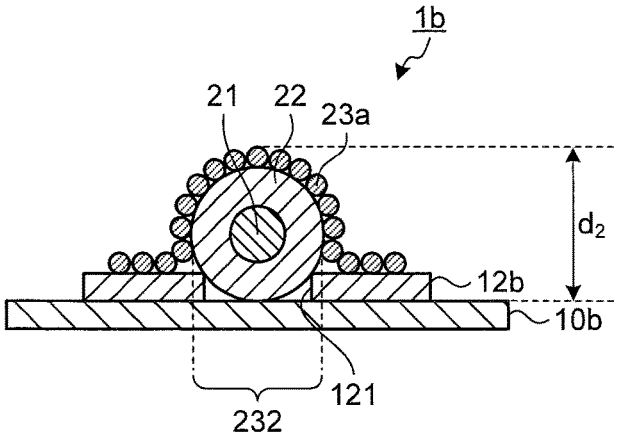
FIG. 8 is a D-D line sectional view of the cable connection structure illustrated in FIG. 7.

FIG. 7 is a schematic diagram of an outline structure of a cable connection structure according to a third embodiment of the present invention. FIG. 8 is a D-D line sectional view of the cable connection structure illustrated in FIG. 7. The same reference signs are used to designate the same elements as the above-described elements. A cable connection structure 1*b* according to the third embodiment includes a substrate 10*b* having an electronic component and the like mounted thereon and a cable 20*a* connected to the substrate 10*b*.

The substrate 10*b* has a substantially plate shape, and an electric circuit, an electrode, and the like are formed on at least one principal surface. On one principal surface of the substrate 10*b*, a first electrode 11 electrically connected to the cable 20*a* and a second electrode 12*b* connected to a shield 23*a* of the cable 20*a* are formed. The second electrode 12*b* is a ground electrode.

The cable 20*a* includes the core wire 21, the inner insulator 22, the shield 23*a* which extends along the longitudinal direction of the inner insulator 22 and includes a plurality of conductors for covering the outer circumference of the inner insulator 22, an outer insulator 24 including an insulator for covering the outer circumference of the shield 23*a*. The inner insulator 22, the shield 23*a*, and the outer insulator 24 are stripped in a stepped manner to form the cable 20*a* at the end part where the substrate 10*b* is connected. The cross section of the shield 23*a* perpendicular to the longitudinal direction of the conductor has a substantially annular shape.

In the shield 23*a*, an exposed portion 232 which is formed by separating a part of the conductors is formed, and a part of the inner insulator 22 is exposed in the exposed portion 232.

The cable 20*a* is fixed with the joining material at the distal end of the core wire 21 and is electrically connected to the first electrode 11.

Here, the second electrode 12*b* is divided in a direction substantially perpendicular to the arrangement direction of the first electrode 11 and the second electrode 12*b* (longitudinal direction of second electrode 12*b*). By this division, a hollow portion 121 as a hollow space is formed in the second electrode 12*b*. The length (width) of the hollow portion 121 in the longitudinal direction is designed such that at least the inner insulator 22 of the cable 20*a* has contact with the principal surface of the substrate 10*b* so as to be housed in the hollow portion 121. The second electrode 12*b* is electrically connected by wiring formed on the surface or in the substrate 10*b*.

The cable 20*a* is arranged such that the exposed portion 232 of the shield 23*a* faces to the side of the substrate 10*b*. The cable 20*a* is connected to the substrate 10*b* in a state where the surface of the inner insulator 22 in the exposed portion 232 has been positioned in the hollow portion 121 (between the divided parts of the second electrode 12*b*) and has had contact with the principal surface of the substrate 10*b* via the hollow portion 121. The conductors separated to form the exposed portion 232 of the shield 23*a* are fixed on the second electrode 12*b* via the joining material.

Here, as illustrated in FIG. 8, a distance $d_2$ between the principal surface of the substrate 10*b* to the end of the shield 23*a* is smaller than a value obtained by adding a diameter of a circle having contact with the outer edge of each conductor of the shield 23*a* to a board thickness of the second electrode 12*b* (distance perpendicular to the principal surface). The distance $d_2$ corresponds to the length in the direction perpendicular to the principal surface of the substrate 10*b* and in the direction for passing through the center of the cable 20*a* (core wire 21).

In this way, the substrate 10*b* is connected to the inner insulator 22 in a state where the exposed portion 232 has been formed and the inner insulator 22 has had contact with the principal surface of the substrate 10*b*. Accordingly, the attachment height of the cable 20*a* relative to the substrate 10*b* can be lower than that in a case where the exposed portion 232 is not formed in the shield 23*a*.

According to the third embodiment, in the shield 23*a*, the exposed portion 232 in which a part of the inner insulator 22 is exposed is formed by separating a part of the conductors, and the inner insulator 22 has contact with the principal surface of the substrate 10*b* through the exposed portion 232. Also, the plurality of cables 20*a* is connected to the substrate 10*b* by contacting the conductors separated to form the exposed portion 232 with the second electrode 12*b*. Therefore, the attachment height of the cable relative to the substrate can be lowered without microfabrication on the substrate.

Further, in the third embodiment, since the inner insulator 22 is put into a position contacting with the principal surface of the substrate 10*b*, the distance $d_2$ is smaller than the distance $d_1$. Accordingly, relative to the first and second embodiments, the attachment height of the cable relative to the substrate can be further lowered.

Fourth Embodiment

Figure 9:
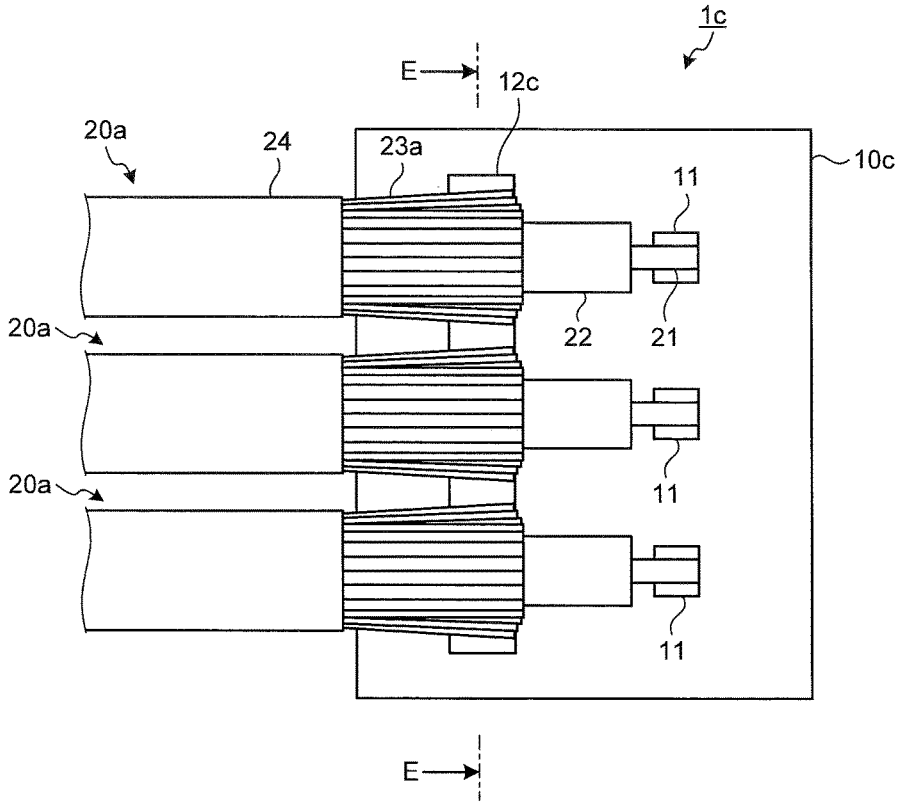
FIG. 9 is a schematic diagram of an outline structure of a cable connection structure according to a fourth embodiment of the present invention.
Figure 10:
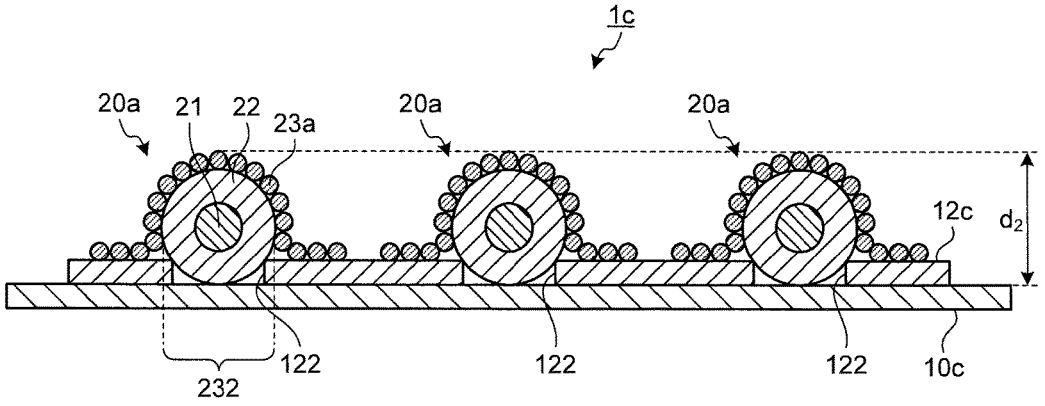
FIG. 10 is an E-E line sectional view of the cable connection structure illustrated in FIG. 9.

FIG. 9 is a schematic diagram of an outline structure of a cable connection structure according to a fourth embodiment of the present invention. FIG. 10 is an E-E line sectional view of the cable connection structure illustrated in FIG. 9. The same reference signs are used to designate the same elements as the above-described elements. In a cable connection structure 1*c* according to the fourth embodiment, the plurality of cables 20*a* is connected to a substrate 10*c*.

The substrate 10*c* has a substantially plate shape, and an electric circuit, an electrode, and the like are formed on at least one principal surface. A plurality of first electrodes 11 electrically connected to the cables 20*a* is formed on one principal surface of the substrate 10*c*. On one of the principal surface of the substrate 10*c*, a second electrode 12*c* is formed which extends in an arrangement direction of the plurality of cables 20*a* and is connected to the shields 23*a* of the cables 20*a*. The second electrode 12*c* is a ground electrode connected to each shield 23*a*.

Here, the second electrode 12*c* is divided in the longitudinal direction according to the number of the arranged cables 20*a*. In the second electrode 12*c*, a plurality of hollow portions 122 as a hollow space is formed (according to the number of the arranged cables 20*a*) by this division. The length of the hollow portion 122 in the longitudinal direction is designed such that at least the inner insulator 22 of the cable 20*a* has contact with the principal surface of the substrate 10*c* so as to be housed in the hollow portion 122. The second electrode 12*c* is electrically connected by wiring formed on the surface or in the substrate 10*c*.

The cable 20*a* is arranged such that the exposed portion 232 of the shield 23*a* faces to the side of the substrate 10*c*. The cable 20*a* is connected to the substrate 10*c* in a state where the surface of the inner insulator 22 in the exposed portion 232 has been positioned in the hollow portion 122 (between divided parts of the second electrode 12*c*) and has had contact with the principal surface of the substrate 10*c* via the hollow portion 122. The conductors separated to form the exposed portion 232 of the shield 23*a* are fixed on the second electrode 12*c* via the joining material.

Here, similarly to the third embodiment, a distance between the principal surface of the substrate 10*c* and the end of the shield 23*a* becomes the distance $d_2$ (refer to FIG. 8) smaller than a value obtained by adding a diameter of a circle having contact with the outer edge of each conductor of the shield 23*a* to a board thickness of the second electrode 12*c*.

In this way, the substrate 10*c* is connected to the inner insulator 22 in a state where the exposed portion 232 has been formed and the inner insulator 22 has had contact with the principal surface of the substrate 10*c*. Accordingly, the attachment height of the cable 20*a* relative to the substrate 10*c* can be lower than that in a case where the exposed portion 232 is not formed in the shield 23*a*.

According to the fourth embodiment, in the shield 23*a*, the exposed portion 232 in which a part of the inner insulator 22 is exposed is formed by separating a part of the conductors, and the inner insulator 22 has contact with the principal surface of the substrate 10*c* through the exposed portion 232. Also, the plurality of cables 20*a* is connected to the substrate 10*c* by contacting the conductors separated to form the exposed portion 232 with the second electrode 12*c*. Therefore, the attachment height of the cable relative to the substrate can be lowered without microfabrication on the substrate.

In the third and fourth embodiments, the inner insulator 22 is connected to the substrate 10*c* in a state where the surface of the inner insulator 22 in the exposed portion 232 has contact with the principal surface of the substrate 10*b* or 10*c*. However, the above-mentioned effect can be obtained when the surface is positioned in the hollow portion 121 or 122 (between divided parts of the second electrode 12*b* or 12*c*). Therefore, when at least a part of the surface of the inner insulator 22 in the exposed portion 232 is positioned in the hollow portions 121 and 122, a structure in which the surface of the inner insulator 22 does not have contact with the principal surface of the substrates 10*b* and 10*c* can be applied.

Fifth Embodiment

Figure 11:
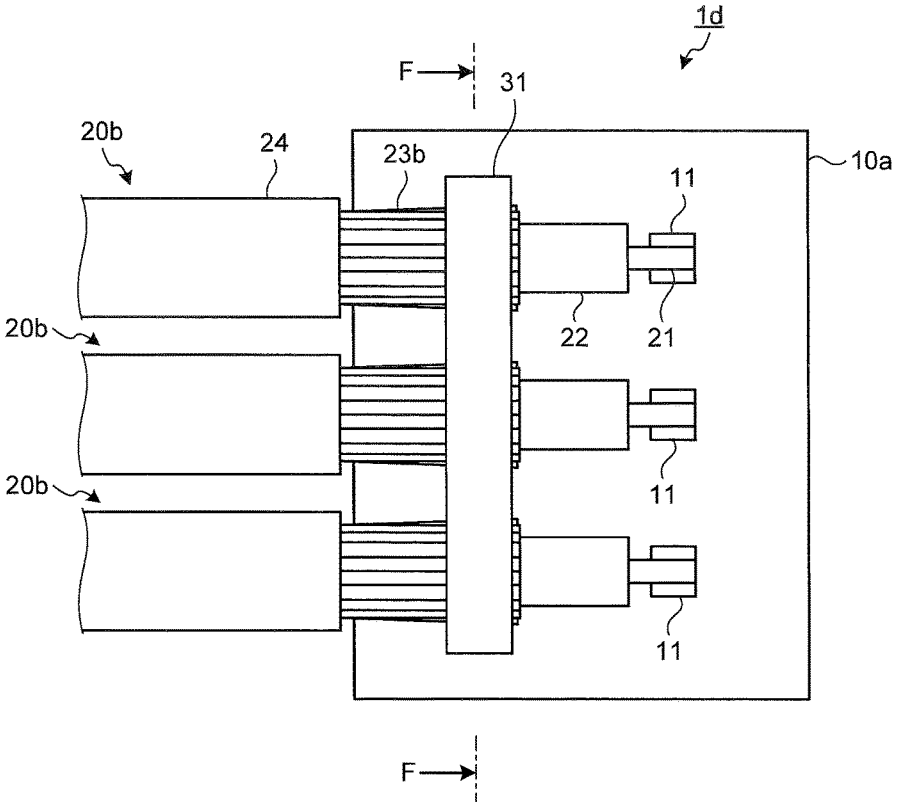
FIG. 11 is a schematic diagram of an outline structure of a cable connection structure according to a fifth embodiment of the present invention.
Figure 12:
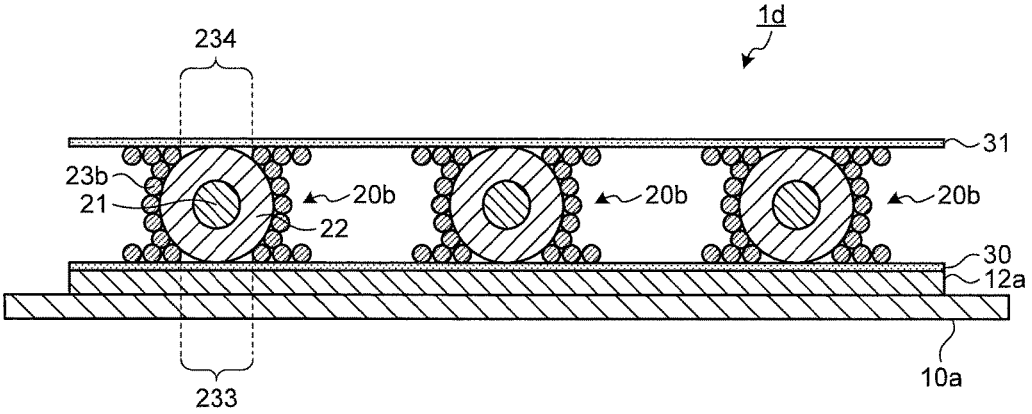
FIG. 12 is an F-F line sectional view of the cable connection structure illustrated in FIG. 11.

FIG. 11 is a schematic diagram of an outline structure of a cable connection structure according to a fifth embodiment of the present invention. FIG. 12 is an F-F line sectional view of the cable connection structure illustrated in FIG. 11. A cable connection structure 1*d* according to the fifth embodiment includes the substrate 10*a*, a plurality of cables 20*b* connected to the substrate 10*a*, and a holding member 30 (first holding member) and a holding member 31 (second holding member) for collectively holding the plurality of cables 20*b*.

The substrate 10*a* has a substantially plate shape, and an electric circuit, an electrode, and the like are formed on at least one principal surface. A plurality of first electrodes 11 electrically connected to the cables 20*b* is formed on one principal surface of the substrate 10*a*. On one principal surface of the substrate 10*a*, a second electrode 12*a* is formed which extends in the arrangement direction of the plurality of cables 20*b* and is connected to the holding member 30.

The cable 20*b* includes: the core wire 21; the inner insulator 22; a shield 23*b* which extends along the longitudinal direction of the inner insulator 22 and includes a plurality of conductors for covering the outer circumference of the inner insulator 22; and an outer insulator 24 formed of an insulator for covering the outer circumference of the shield 23*b*. The inner insulator 22, the shield 23*b*, and the outer insulator 24 are stripped in a stepped manner to form the cable 20*b* at the end part where the substrate 10*a* is connected. The cross section of the shield 23*b* perpendicular to the longitudinal direction of the conductor has a substantially annular shape.

The holding members 30 and 31 are ground bars including conductive materials having belt shapes. The holding members 30 and 31 collectively hold the plurality of cables 20*b* by being connected to a part of the conductors of each shield 23*b* via a joining material and the like. The holding members 30 and 31 are electrically grounded.

Here, in the shield 23*b*, exposed portions 233 and 234 which are formed by separating a part of the conductors is formed, and a part of the inner insulator 22 is exposed in the exposed portions 233 and 234. The exposed portions 233 and 234 are provided at positions opposite to each other relative to the center of the core wire 21.

In the cable 20*b*, the exposed portions 233 and 234 of the shield 23*b* are respectively arranged opposite to the principal surfaces of the holding members 30 and 31. The cable 20*b* is connected to the substrate 10*a* in a state where the surfaces of the inner insulator 22 in the exposed portions 233 and 234 respectively contact with the principal surfaces of the holding members 30 and 31. The conductors separated to form the exposed portions 233 and 234 of the shield 23 are respectively fixed to the holding members 30 and 31 via the joining material.

Figure 13:
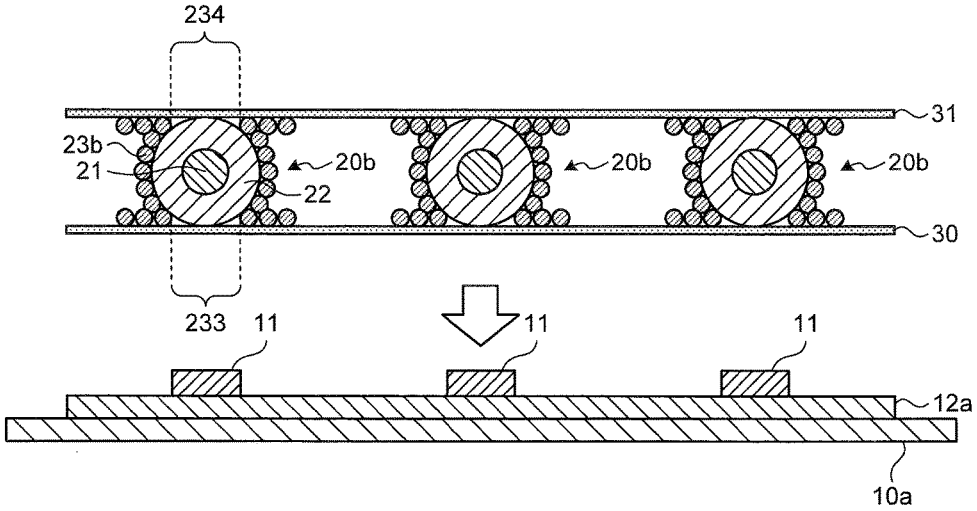
FIG. 13 is a diagram to describe an assembly of the cable connection structure according to the fifth embodiment of the present invention.

FIG. 13 is a diagram to describe an assembly of the cable connection structure according to the fifth embodiment. When the substrate 10*a* is connected to the cable 20*b*, as illustrated in FIG. 13, the plurality of cables 20*b* which has been collectively held by the holding member 30 and 31 is placed on the substrate 10*a*, and each core wire 21 has contact with the first electrode 11.

After that, the first electrode 11 and the core wire 21 are fixed with the joining material and are electrically connected to each other. As the joining member, for example, a conductive joining member which is not illustrated such as solder, an ACF, and ACP is exemplified. Also, the holding member 30 is fixed to the second electrode 12*a* via the joining material.

In this way, the exposed portions 233 and 234 are formed, and the inner insulator 22 is contacted with the principal surfaces of the holding members 30 and 31. In this state, these are connected to the substrate 10*a*. Accordingly, even when the holding members 30 and 31 are used, the attachment height of the cable 20*b* relative to the substrate 10*a* can be lower than that in a case where the exposed portions 233 and 234 are not formed in the shield 23*b*.

According to the fifth embodiment, in the shield 23*b*, the exposed portions 233 and 234 in which a part of the inner insulator 22 is exposed are formed by separating a part of the conductors, and the inner insulator 22 has contact with the holding members 30 and 31 through the exposed portions 233 and 234. Also, the cable 20*b* is connected to the substrate 10*a* by contacting the conductors separated to form the exposed portions 233 and 234 respectively with the holding members 30 and 31. Therefore, the attachment height of the cable relative to the substrate can be lowered without microfabrication on the substrate.

Further, according to the fifth embodiment, the plurality of cables 20*b* is attached to the substrate 10*a* in a state where the cables 20*b* are collectively held by the holding members 30 and 31. Therefore, it is easier to assemble the cable connection structure.

In the fifth embodiment, the plurality of cables 20*b* is collectively held by the holding members 30 and 31. However, the cables 20*b* may be held by one of the holding members. For example, when only the holding member 30 is used, a part of the inner insulator 22 exposed to outside by the exposed portion 233 has contact with the second electrode 12*a*, and the conductors of the shield 23*b* are fixed to the second electrode 12*a*.

Modification of Fifth Embodiment

Figure 14:
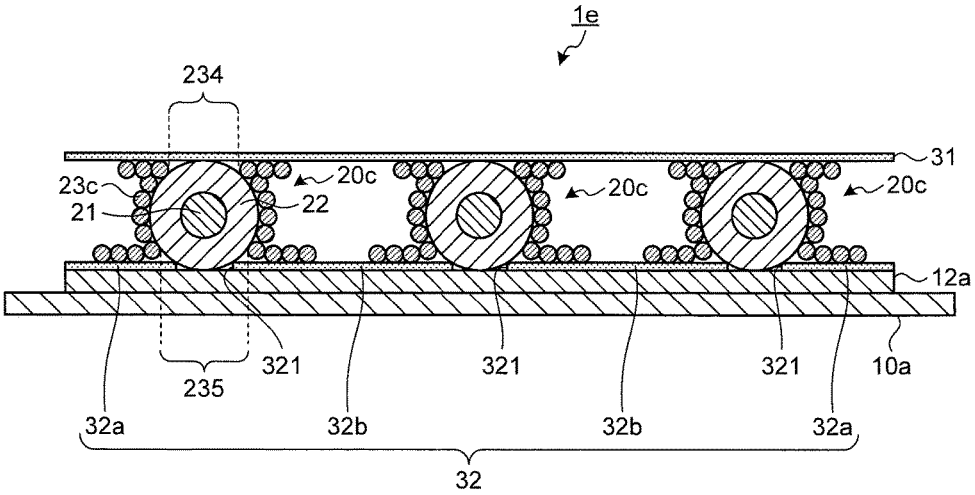
FIG. 14 is a sectional view of an outline structure of a cable connection structure according to a modification of the fifth embodiment of the present invention.

FIG. 14 is a sectional view of an outline structure of a cable connection structure according to a modification of the fifth embodiment of the present invention. A cable connection structure 1*e* according to the modification of the fifth embodiment includes a holding member 32 (first holding member) and a cable 20*c* instead of the holding member 30 and the cable 20*b* according to the fifth embodiment. The holding member 32 includes, for example, a plurality of strip-shaped members 32*a* and 32*b* having a length according to the interval between first electrodes 11. In the holding member 32, the strip-shaped members 32*a* and 32*b* are provided such that a plane on the principal surfaces of the strip-shaped members 32*a* and 32*b* is arranged in parallel to the principal surface of the holding member 31.

The strip-shaped members 32*a* are arranged so as to be positioned on both sides of the holding member 32 in the longitudinal direction of the holding member 32. Also, the strip-shaped member 32*b* is arranged between the strip-shaped members 32*a* and arranged according to the arrangement intervals of the plurality of cables 20*c*. It is preferable that the interval between the strip-shaped members 32*a* and 32*b* be a distance in which the inner insulator 22 can be held in a state where the outer circumference of the inner insulator 22 is positioned on the plane for passing through the principal surfaces of the strip-shaped members 32*a* and 32*b*.

The cable 20*c* includes the core wire 21, the inner insulator 22, a shield 23*c* which extends along the longitudinal direction of the inner insulator 22 and includes a plurality of conductors for covering the outer circumference of the inner insulator 22, and an outer insulator 24 formed of an insulator for covering the outer circumference of the shield 23*c*. The inner insulator 22, the shield 23*c*, and the outer insulator 24 are stripped in a stepped manner to form the cable 20*c* at the end part where the substrate 10*a* is connected.

In the shield 23*c*, an exposed portions 234 and 235 which are formed by separating a part of the conductors are formed, and a part of the inner insulator 22 is exposed in the exposed portions 234 and 235.

Here, in the holding member 32, hollow portions 321 are formed by arranging a space between the strip-shaped member 32*a* and the strip-shaped member 32*b* and a space between the strip-shaped members 32*b* at predetermined intervals. The length of the hollow portion 321 in the longitudinal direction is designed as a width such that at least the outer surface of the inner insulator 22 of the cable 20*c* has contact with a plane for passing through the principal surfaces of the strip-shaped members 32*a* and 32*b*, and the inner insulator 22 can be housed in the hollow portion 321.

The cable 20*c* is arranged such that the exposed portion 234 of the shield 23*c* faces to the side of the holding member 31 and the exposed portion 235 faces to the hollow portion 321. On the other hand, the cable 20*c* is connected to the substrate 10*a* in a state where the surface of the inner insulator 22 housed in the hollow portion 321 and the holding member 32 have contact with the second electrode 12*a*. The conductors separated to form the exposed portions 234 and 235 of the shield 23*c* are fixed to the holding member 32 (strip-shaped members 32*a* and 32*b*) via the joining material.

Figure 15:
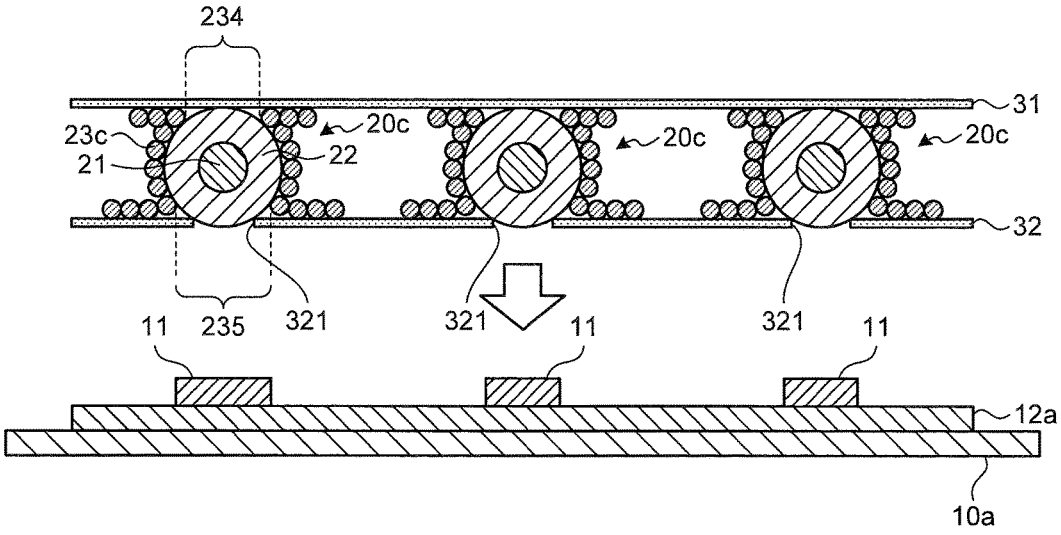
FIG. 15 is a diagram to describe an assembly of the cable connection structure according to the modification of the fifth embodiment of the present invention.

FIG. 15 is a diagram to describe an assembly of the cable connection structure according to the modification of the fifth embodiment. When the substrate 10*a* is connected to the cable 20*c*, as illustrated in FIG. 15, the plurality of cables 20*c* which has been collectively held by the holding members 31 and 32 is placed on the substrate 10*a*, and each core wire 21 has contact with the first electrode 11.

After that, the first electrode 11 and the core wire 21 are fixed with the joining material and are electrically connected to each other. As the joining member, for example, a conductive joining member which is not illustrated such as solder, an ACF, and ACP is exemplified. Also, the holding member 32 is fixed to the second electrode 12*a* via the joining material.

In this way, the surface of the inner insulator 22 exposed through the exposed portion 234 has contact with the principal surface of the holding member 31, and the surface of the inner insulator 22 exposed through the exposed portion 235 is positioned in the hollow portion 321 (between divided parts of the holding member 32) and is connected to the substrate 10*a* in a state where the surface has contact with the second electrode 12*a* through the hollow portion 321. Accordingly, even when the holding members 31 and 32 are used, the attachment height of the cable 20*c* relative to the substrate 10*a* can be lower than that in a case where the exposed portions 234 and 235 are not formed in the shield 23*c*.

According to the modification of the fifth embodiment, in the shield 23*c*, the exposed portions 234 and 235 in which a part of the inner insulator 22 is exposed are formed by separating a part of the conductors, and the inner insulator 22 has contact with the holding member 31 through the exposed portion 234. Further, the inner insulator 22 has contact with the second electrode 12*a* through the exposed portion 235 and the hollow portion 321, and the conductors separated to form the exposed portions 234 and 235 respectively have contact with the holding members 31 and 32. In this way, the cable 20*c* is connected to the substrate 10*a*. Accordingly, the attachment height of the cable relative to the substrate can be lowered without microfabrication on the substrate.

Further, according to the modification of the fifth embodiment, the plurality of cables 20*c* is attached to the substrate 10*a* in a state where the cables 20*c* are collectively held by the holding members 31 and 32. Therefore, it is easier to assemble the cable connection structure.

Further, in the modification of the fifth embodiment, since the inner insulator 22 is put into a position contacting with the principal surface of the second electrode 12*a*, the attachment height of the cable relative to the substrate can be further lower than that in the fifth embodiment.

In the modification of the fifth embodiment, the holding member 31 may have contact with the second electrode 12*a* by turning the cable connection structure 1*e* upside down. In this case, the holding member 31 functions as the first holding member, and the holding member 32 functions as the second holding member. Also, the attachment height of the cable relative to the substrate can be further lowered by using the holding member 32 instead of the holding member 31.

Further, in the modification of the fifth embodiment, the cable 20*c* is connected to the substrate 10*a* in a state where the surface of the inner insulator 22 in the exposed portion 235 has contact with the second electrode 12*a*. However, when the surface is positioned in the hollow portion 321, the above-mentioned effect can be obtained. Therefore, when at least a part of the surface of the inner insulator 22 in the exposed portion 235 is positioned in the hollow portion 321, a structure in which the surface of the inner insulator 22 does not have contact with the principal surface of the second electrode 12*a* can be applied.

In the first to fifth embodiments, the exposed portion is formed by separating the conductors of the shield. However, the exposed portion may be formed by cutting off a part of the conductors.

According to some embodiments, it is possible to lower an attachment height of a cable relative to a substrate without microfabrication on the substrate.

The cable connection structure according to some embodiments is suitable for connecting a substrate of an imaging element of an endoscope and a coaxial cable, for example.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cable connection structure comprising:

one or a plurality of cables, wherein the one or each of the plurality of cables comprises:

a core wire comprising a line-shaped conductive material;

a tubular inner insulator configured to cover an outer circumference of the core wire;

a shield which extends along a longitudinal direction of the tubular inner insulator and comprises a plurality of conductors configured to cover a partial portion of an outer circumference of the tubular inner insulator and also to expose an exposed portion for exposing of the outer circumference of the tubular inner insulator; and an outer insulator configured to cover an outer circumference of the shield, wherein the shields, the tubular inner insulator, and the core wire are exposed in a stepped manner toward a front end of the one or the each of the plurality of cables;

a substrate;

a first electrode provided on the substrate, wherein the first electrode is configured to be electrically connected to an exposed portion of the core wire; and a second electrode provided on the substrate, wherein the second electrode is configured to be electrically connected to the shield, wherein the exposed portion of the outer circumference of the tubular inner insulator is configured to directly contact a surface of the second electrode.

2. The cable connection structure according to claim 1, wherein the exposed portion of the outer circumference of the tubular inner insulator is formed by separating a part of the plurality of conductors.

3. The cable connection structure according to claim 1, wherein the exposed portion of the outer circumference of the tubular inner insulator is formed by cutting off a part of the plurality of conductors.

* * * * *